US010617197B2

(12) United States Patent
Ketcher

(10) Patent No.: US 10,617,197 B2
(45) Date of Patent: Apr. 14, 2020

(54) SINGLE MOUNT SUPPORTED HAMMOCK

(71) Applicant: Randy Ketcher, Watertown, MN (US)

(72) Inventor: Randy Ketcher, Watertown, MN (US)

( * ) Notice: Subject to any disclaimer, the term of this patent is extended or adjusted under 35 U.S.C. 154(b) by 104 days.

(21) Appl. No.: 15/724,335

(22) Filed: Oct. 4, 2017

(65) Prior Publication Data

US 2018/0070709 A1 Mar. 15, 2018

Related U.S. Application Data

(63) Continuation-in-part of application No. 15/260,663, filed on Sep. 9, 2016, now abandoned.

(51) Int. Cl.

| | |
|---|---|
| ***A45F 3/22*** | (2006.01) |
| ***A45F 3/24*** | (2006.01) |
| *E02B 3/24* | (2006.01) |

(52) U.S. Cl.

CPC . *A45F 3/24* (2013.01); *E02B 3/24* (2013.01)

(58) Field of Classification Search

CPC ..... A45F 3/22; A45F 3/24

USPC ..... 5/123, 127, 129

See application file for complete search history.

(56) References Cited

U.S. PATENT DOCUMENTS

| | | | | |
|---|---|---|---|---|
| 968,017 A | | 8/1910 | Wilson | |
| 4,925,138 A | * | 5/1990 | Rawlins | A45F 3/24 248/165 |
| 6,467,110 B1 | * | 10/2002 | Ketcher | A45F 3/22 5/120 |
| 6,912,744 B2 | * | 7/2005 | Lyons | A45F 3/24 5/122 |

FOREIGN PATENT DOCUMENTS

CN 2751639 Y 1/2006

OTHER PUBLICATIONS

International Search Report and Written Opinion of the International Searching Authority issued in related application No. PCT/US2018/054104, dated Feb. 14, 2019.

* cited by examiner

*Primary Examiner* — Frederick C Conley

(74) *Attorney, Agent, or Firm* — Amanda M. Prose; Westerman, Champlin & Koehler, P.A.

(57) ABSTRACT

A single mount, dock supported hammock frame that is removably securable to a pre-existing dock post. A first end of the hammock frame is configured to pivot about the connection with the dock post. A hammock can then be secured to opposing ends of the frame and positioned over a body of water near the dock when in use. The frame rises vertically from the dock and horizontally away from the mounting post to secure a hammock from above the hammock, allowing the hammock to freely swing over the water surface.

8 Claims, 3 Drawing Sheets

SINGLE MOUNT SUPPORTED HAMMOCK

CROSS-REFERENCE TO RELATED APPLICATION

This application claims the benefit of and is a continuation-in-part of application Ser. No. 15/260,663, filed on Sep. 9, 2016, the content of which is incorporated herein in its entirety.

BACKGROUND OF THE INVENTION

Hammocks are usually supported by a framework holding each end of the hammock, with the framework having a plurality of feet, bars or other support structure supporting the framework on solid ground.

There have been some efforts to attach hammocks to various structures such as automobiles, the side of a home, and to a dock as in U.S. Pat. No. 6,467,110 which is incorporated herein in its entirety. Such efforts have produced hammocks that are not secure when supporting a person and further that are prone to tipping over or "dumping out" the person in the hammock.

SUMMARY

An aspect of the present disclosure relates to a single mount supported hammock comprising a frame for supporting the hammock. The frame comprises a sleeve configured for rotatably connecting the frame with a pre-existing dock post or other vertical post. The frame also comprises a first hammock attachment mechanism secured to a first post length of the frame and a second hammock attachment mechanism secured to a second, opposing post length of the frame such that the attachment mechanisms are spaced apart and positioned on opposing ends of the frame. The first and second hammock attachment mechanisms are each horizontally oriented with respect to the vertical post length to which they are secured by way of a vertical section substantially centered in the attachment mechanism and that is configured for securable connection with the respected post length of the frame.

The first and second hammock attachment mechanisms are each configured for receiving an opposing end of the hammock at least partially wound therearound. The opposing ends of the hammock comprise a plurality of rope ends and wherein the rope ends are each spaced apart and wound at least partially wound around the respective attachment mechanism.

Another aspect of the present disclosure relates to a frame for supporting a hammock having a framework comprising a plurality of interconnected tubular sections and wherein at least one tubular section is configured to be rotatably secured to a pre-existing dock post (or other vertical post). Two attachment mechanisms are configured to support the hammock secured to the framework and each attachment mechanism comprises a horizontal tubular section secured to a vertical tubular section such that the attachment mechanisms are secured in a generally horizontal position on opposing sides of the framework, and are secured at approximately the same vertical position on the respective vertical tubular sections of the framework.

The attachment mechanisms are each configured to receive an end length of the hammock such that the end length of the hammock is at least partially wound around the respective attachment mechanism.

A mounting loop may then be positioned on one interconnected tubular sections positioned under the mounted hammock and the mounting loop is configured for connection with terminal ends of the hammock for securing the hammock to the frame at a selected tension.

Another aspect of the present disclosure relates to a method of mounting a hammock to a post, such as a dock post or other secured post, and positioning the hammock. The method comprises providing a hammock frame comprising a first generally vertical post and a generally vertical second post, each post spaced apart from one another and connected by a third post extending there between. A first end of the first generally vertical post is configured for rotatable connection with a pre-existing dock post. The method comprises securing a first end of the hammock to a first hammock attachment mechanism wherein the first hammock attachment mechanism is horizontally secured to a selected vertical position on the first generally vertical post by at least partially wrapping an end length of the first end of the hammock around the horizontal length and securing a second, opposing end of the hammock to a second hammock attachment mechanism, wherein the second hammock attachment mechanism is horizontally secured to a selected vertical position on the second generally vertical post by at least partially wrapping an end length of the second end of the hammock around the horizontal length; and rotatably securing the hammock frame to the dock post.

Because the frame is rotatable about its connection to the dock post, the frame is rotatable towards and away from the dock post such that the hammock can be secured to the frame before or after the frame is secured to the dock post.

DETAILED DESCRIPTION

The present disclosure relates to a hammock that is configured to be securely supported and attached to a single boat dock post. The dock post may be positioned on the side or end of a boat dock. The dock post and dock sufficiently distribute the forces created by the weight of an individual in the hammock.

The hammock of the present disclosure can be rotatably secured to various types and styles of existing dock posts. Docks generally comprise a metal frame work and metal dock posts are driven into the lakebed to support the dock. The tops of the dock posts generally extend two to four feet above the top of the deck surface. The hammock frame is configured to be attached to such boat dock posts. Boat dock posts typically use schedule 40 steel posts, and they are typically 1½ inch in diameter. The steel can be galvanized if desired.

Figure 1A:
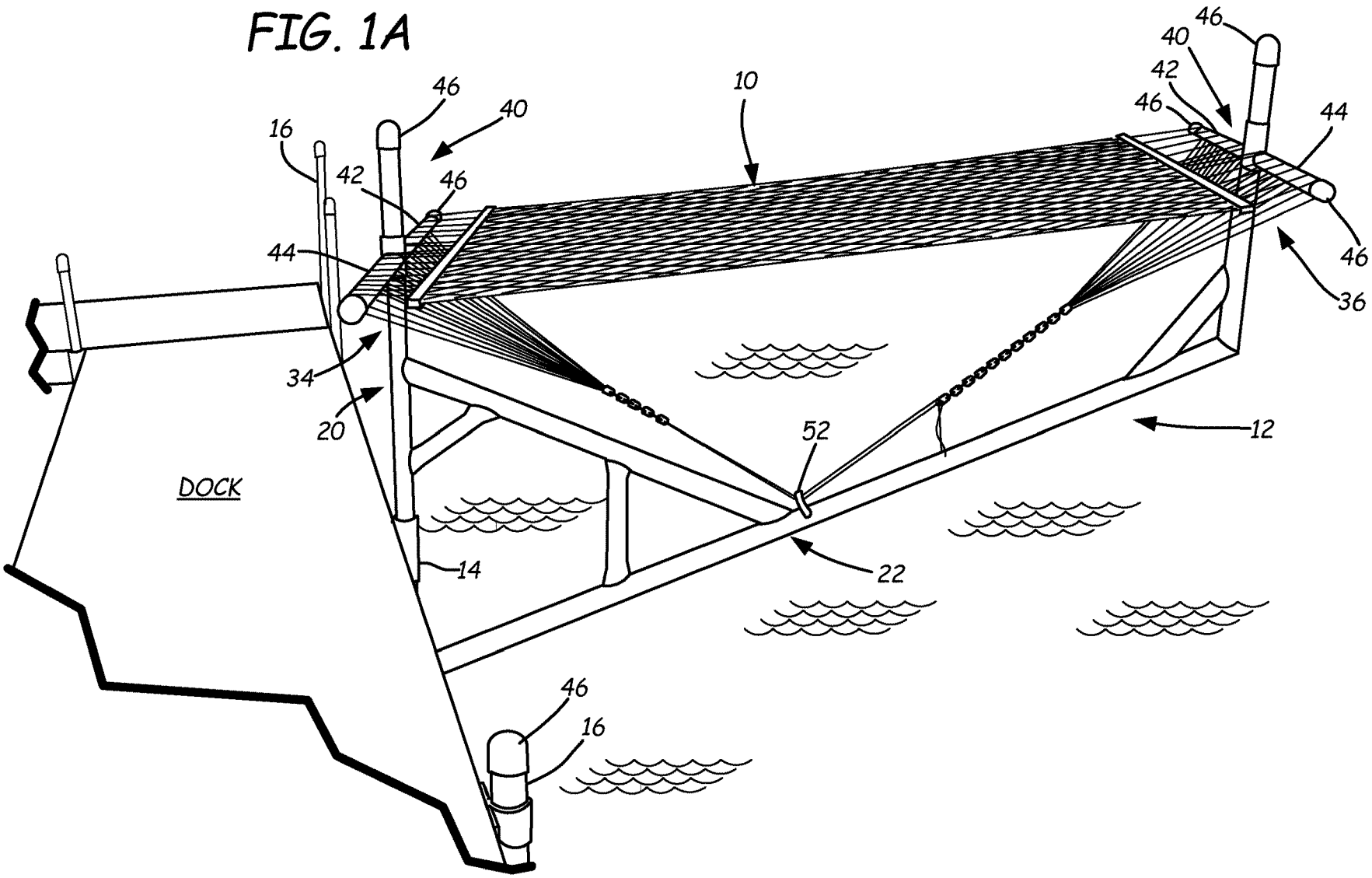
FIG. 1A is a perspective view of the single mount dock supported hammock of the present disclosure.
Figure 1B:
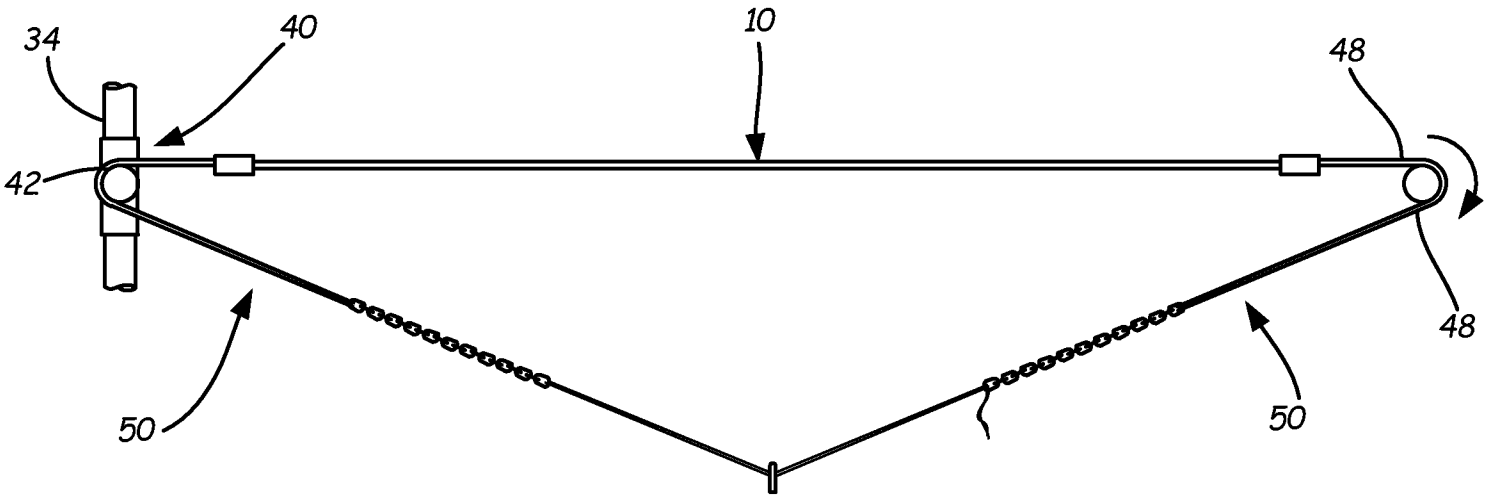
FIG. 1B is a side view of the hammock mounted to a framework showing only attachment mechanisms and a mounting loop for clarity.

A hammock 10 and hammock framework 12 is illustrated generally in FIG. 1. The framework 12 has a sleeve 14 constructed of two-inch diameter schedule 40 steel pipe. The steel for the hammock support can be galvanized or made from other sturdy material. The sleeve 14 slides over a top of a boat dock post 16. The post 16 is usually driven into the lakebed. The sleeve 14 is constructed so that it sits on top of a metal dock bracket (not shown). The sleeve 14 is then free to rotate about the post 16 supported by the dock bracket.

The hammock framework 12 has a main post 20, which is attachable to the sleeve 14. The main post 20 may be welded to the sleeve 14.

The hammock framework also has a support post 22, which is attached to the main post near the middle of the main post. The attachment can be a weld or other means. The support post 22 can be one straight piece, or it can be bent in the middle, or it can consist of two pieces that are joined by weld or telescopic joint. A second end of the support post 22 may journal about the dock post 16. The end of the post 22 has a journal bracket welded to the post. The journal bracket can consist of an open piece of schedule 40, two-inch pipe. The bracket fits partially around the post 16 and facilitates the rotation of the frame 12 around the dock post 16. The means of attachment of the frame to the dock post is described in U.S. Pat. No. 6,467,110, the contents of which are incorporated herein in their entirety.

The framework 12 also has a brace which supports the main post 20 and the support post 22. It also can be attached by weld. It should be understood that instead of welds the various parts can be attached by the use of telescopingly mounted pipes of varying diameter such as shown in U.S. Pat. No. 5,297,302. It should also be understood that the main post 20, support post 22 and brace may be bent if desired or each may consist of more than one part which are attached together in some fashion. Depending on the shape of the main post 20 and the support post 22, a brace may not be needed.

Figure 2A:
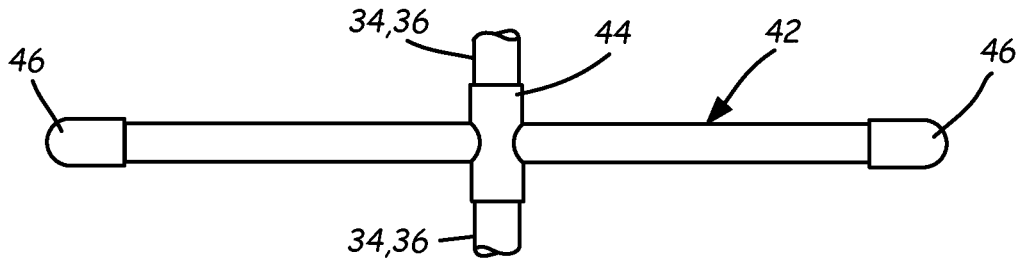
FIG. 2A is front view of a mounting mechanism for mounting the hammock to the framework.
Figure 2B:
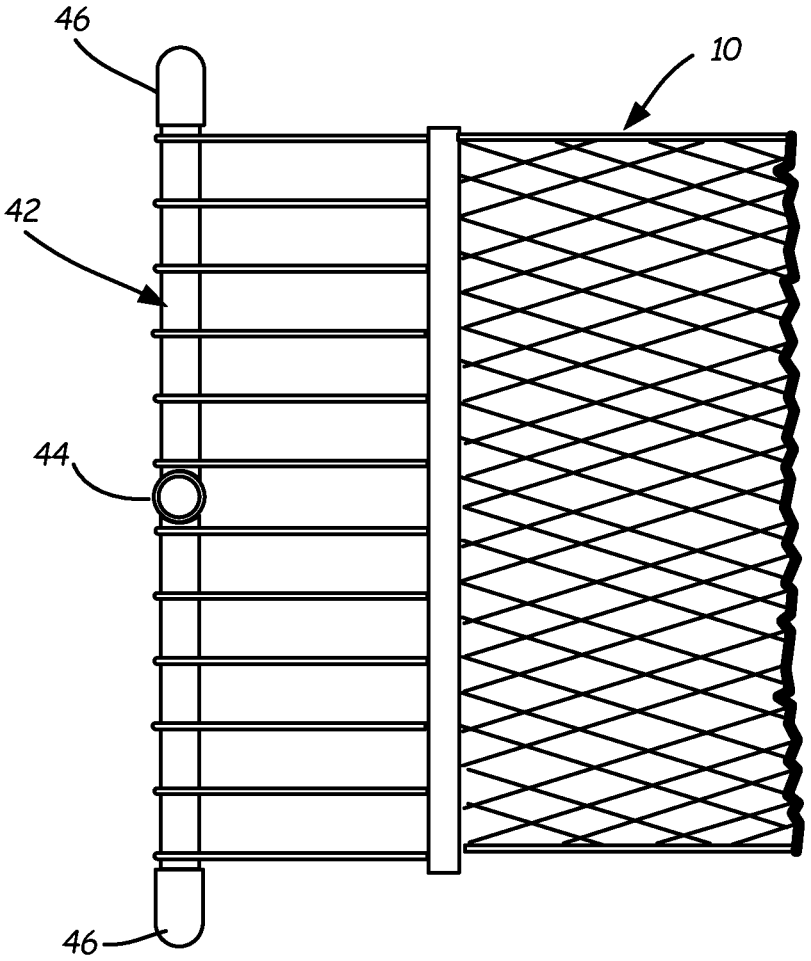
FIG. 2B is a perspective view of the mounting of the hammock to the mounting mechanism.

As illustrated in further detail in FIG. 2, a top section 30, 32 of each opposing side post 34, 36 of the framework 12 is configured for attachment of the hammock 10 such that the hammock spans across the framework 12. An attachment mechanism 40 is provided for each opposing side 34, 36 of the framework 12. Each attachment mechanism 40 comprises a first length 24 of tubing or piping, the length 42 is generally horizontally mounted and secured to opposing sides of a generally vertically oriented mounting tube 44. That is, each mounting tube 44 comprises a tube of a sufficient length for mounting to the framework 12 wherein the center length of tube 44 has a diameter sufficient to allow the mounting tube 44 to slide over a vertical length 34, 36 of framework 12 for attachment to the framework 12. The mounting tube may be welded to the framework 12 at a vertical height selected and sufficient for operably mounting the hammock 10 on the framework 12, or may otherwise be vertically secured by means of a lock or similar mechanism.

The attachment mechanisms 40 are secured at substantially the same vertical height (e.g., vertical distance from a top or end of the respective side 34, 36 of the framework 12. The attachment mechanism 40 are secured to the framework 12 such that vertical movement of the attachment mechanism is prevented, as well as rotational movement of the mechanisms 40 about the connection of the tube 44 to the framework 12 is also prevented.

The horizontal lengths 42 of the attachment mechanisms 40 are of substantially equal length to one another such that overall, the length of the attachment mechanism 40 (including the mounting tube 44) is substantially equal to or greater than the width of the hammock 10. The mounting tube 44 is positioned generally in the center of the horizontal length 42 and may be integrally formed or otherwise the attachment mechanism may comprises one or more lengths 42 welded or otherwise fixedly assembled. Terminal ends of the framework 12 and attachment mechanisms 40 (e.g., terminal ends of lengths 42) may be provided with caps 46 for safety and aesthetics.

To securely attach the hammock 10 to the framework in a safe manner that prevents unwanted tipping or wavering of the hammock 10 with and without a user therein, each opposing end of the hammock 10, namely, the ropes, is secured to one attachment mechanism 40 that is securable or secured to the framework 12. The ropes 48 of one end of the hammock 10 are individual wound around the lengths 42 of the attachment mechanism 40. For example, approximately half of the ropes 48 are wound at least partially around one of the lengths 42 such that the other half of the ropes 48 are wound at least partially around the opposing length 24 such that the framework 12 is substantially centered under, or around, the hammock 10 attached thereto. This provides a stable, horizontal attachment of the ends of the hammock 10 to the framework 12 as each opposing end of the hammock 12 is mounted in the same or similar manner to the attachment mechanism securable or secured to opposing ends of the framework 12.

It is noted that the hammock 10 is mounted to the attachment mechanism 40 and thus the framework 12 at a position forward of the traditional mounting mechanism provided on standard hammocks. Generally, mountable hammocks have a wooden bar that extends across a width of a hammock in order to provide a surface for sitting or lying by spacing the rope lattice or hammock surface area across the width of the hammock once installed on a framework. Generally the rope ends of the hammock are individually spaced and fed through this wooden bar and the rope end then converge into connection with a single mounting loop (e.g., the ropes converge to connection with a chain having a length of connected loops to allow for adjustable length mounting. With respect to the framework 12 described herein, the mounting of the hammock 10 to the framework 12 is distinct from traditional mountings as illustrated and described below.

Referring to FIG. 2, once the rope 48 lengths fed through a wooden spacer bar of the hammock have been spaced apart and at least partially wound around the attachment mechanism 40, the ropes 48 converge to an apex end 50 of the hammock 10 on each end of the hammock 10. As described above, this terminal apex 50 is generally provided standard on mountable hammocks. This apex 50 passes under the hammock 10 and is latched to or otherwise adjustably secured to mounting loop 52. The mounting loop 52 is secured to the framework 12 by welding or other secure means. The mounting loop 52 may be secured to the framework 12 along any post such that the mounting loop 52 is positioning substantially under the hammock and at a distance between the ends 32, 34 of the framework 12.

The standard hooks or loops provided on the hammock 10 can be connected to the mounting loop 52 to secure the hammock 10 mounted to the framework 12 at a selected hammock length and tension across the framework 12. Additional straps 54 may be provided for attaching to the standard hooks or loops provided on the hammock to provide additional length to the ends of the hammock 10 for mounting to the framework 12. These straps 54 are configured with opposing ends configured to securely connect a mounting end of the hammocks to secure connection with the mounting loop 52 at an adjustable and/or additional length.

The sleeve 14 is pivotably and removably secured to the pre-existing dock post 16 such that the hammock frame 12 is rotatable about the vertical axis of the sleeve 14. Thus, the hammock 10 can be positioned near the dock to allow for a person to get into and out of the hammock 10 and can be swung out over and thus positioned over the water surface.

The hammock frame 12 can then be removed as necessary, for example, in weather conditions adverse to its use or in the winter. However, the frame 12 may be comprised of tubular extrusions or rods of various cross-sectional shapes (e.g. round, cylindrical, square) wherein the frame comprises a post and rod that have a least some length that is hollow. The material of which the frame 12 is constructed may be a metal material such as aluminum or other like materials that are capable of withstanding outdoor conditions and is not prone to rusting.

The hammock frame as described herein may also be configured to mount to posts similar to dock posts such that the hammock may be mounted to a steel post or other metal post that is secured to the ground or to a trailer or other moveable structure. For example, a steel post may be cemented in a ground surface, such as a back yard area, or a post may be mounted to a trailer or other structure, such that the frame as described herein remains pivotably mountable to said post, regardless of the positioning of said steel post.

Although the present disclosure has been described with reference to preferred embodiments, workers skilled in the art will recognize that changes may be made in form and detail without departing from the spirit and scope of the disclosure.

The invention claimed is:

1. A frame for supporting a hammock comprising:

a sleeve configured for rotatably connecting the frame with a support;

a first hammock attachment mechanism secured to a first post vertical length of the frame;

a second hammock attachment mechanism secured to a second, opposing vertical post length of the frame; and wherein the first and second hammock attachment mechanisms are each substantially horizontally oriented with respect to the vertical post length to which they are secured and wherein the vertical post length extends above and below the attachment mechanism secured thereto and wherein the hammock is secured about both attachment mechanism in a manner to prevent tipping of the hammock and where terminal ends of the hammock are finally secured at substantially a same location below the hammock.

2. The frame of claim 1, wherein in the first and second hammock attachment mechanisms are each configured for receiving an opposing end of the hammock at least partially wound therearound.

3. The frame of claim 2, wherein the opposing ends of the hammock comprise a plurality of rope ends and wherein the rope ends are each spaced apart and wound at least partially wound around the respective attachment mechanism.

4. The frame of claim 2, wherein the first hammock attachment mechanism and second hammock attachment mechanism are secured to the frame such that a hammock is mounted hanging from and thus above the frame.

5. The frame of claim 1, and further comprising a mounting loop positioned on a base length of the frame, under the mounted hammock, and wherein the mounting loop is configured for connection with terminal ends of the hammock for securing the hammock to the frame at a selected tension.

6. A frame for supporting a hammock comprising:

a framework comprising:

a plurality of interconnected tubular sections and wherein at least one tubular section is configured to be rotatably secured to a support;

two attachment mechanisms configured to support the hammock secured to the framework with ends of the hammock wound therearound and the attachment mechanisms;

wherein each attachment mechanism comprises a horizontal tubular section vertically and horizontally secured to a vertical tubular section such that the attachment mechanisms are secured on opposing sides of the framework and vertical and rotational movement of the attachment mechanisms are prevented and wherein the attachment mechanisms are secured at approximately the same vertical position on the respective vertical tubular sections of the framework with a portion of the frame work extending above the position of the respective attachment mechanisms and wherein the terminal ends of the hammock are secured to a substantially same position on the frame below the hammock.

7. The frame of claim 6, wherein the attachment mechanisms are each configured to receive an end length of the hammock such that the end length of the hammock is at least partially wound around the respective attachment mechanism.

8. The frame of claim 6, and further comprising a mounting loop positioned on one interconnected tubular section positioned under a mounted hammock wherein the mounting loop is configured for connection with terminal ends of the hammock for securing the hammock to the frame at a selected tension.

* * * * *